US005452633A

United States Patent [19]

Speich

[11] Patent Number: 5,452,633

[45] Date of Patent: Sep. 26, 1995

[54] PROCESS AND DEVICE FOR THE THERMAL CUTTING OF A RUNNING, MELTABLE FABRIC RUN

[76] Inventor: Francisco Speich, Bleumattstrasse 10, Oberfrick, Switzerland

[21] Appl. No.: 30,179

[22] PCT Filed: Jun. 30, 1992

[86] PCT No.: PCT/CH92/00129

§ 371 Date: Mar. 18, 1993

§ 102(e) Date: Jan. 28, 1994

[87] PCT Pub. No.: WO93/01919

PCT Pub. Date: Feb. 4, 1993

[30] Foreign Application Priority Data

Jul. 18, 1991 [CH] Switzerland ..... 2140/91

[51] Int. Cl.[6] ..... B26D 3/02; B26D 3/12; D06H 7/22

[52] U.S. Cl. ..... 83/16; 83/171; 83/651.1; 219/221; 219/233

[58] Field of Search ..... 83/171, 651.1, 83/857, 875, 15, 16; 30/140; 219/233, 221

[56] References Cited

U.S. PATENT DOCUMENTS

| | | | |
|---|---|---|---|
| 3,038,985 | 5/1962 | Sisk | 219/233 X |
| 3,486,957 | 12/1969 | Fish et al. | 83/171 X |
| 4,244,102 | 1/1981 | Bolles . | |
| 4,334,448 | 6/1982 | Messerschmitt | 83/16 X |
| 4,436,010 | 3/1984 | Valentine | 83/651.1 X |
| 4,608,893 | 9/1986 | Huhne | 83/171 |
| 4,650,961 | 3/1987 | Nespor | 219/233 |
| 4,806,400 | 2/1989 | Sancaktar . | |
| 4,850,844 | 7/1989 | Hunting | 83/171 X |
| 5,065,804 | 11/1991 | Kinuhata et al. | 83/171 X |
| 5,101,094 | 3/1992 | Keller et al. | 83/171 X |

FOREIGN PATENT DOCUMENTS

| | | | |
|---|---|---|---|
| 0152672A3 | 8/1985 | European Pat. Off. . | |
| 1372034 | 8/1964 | France . | |
| 2502724A1 | 7/1975 | Germany . | |
| 2520852 | 11/1976 | Germany . | |
| 0295797 | 11/1989 | Japan | 83/171 |
| 843483 | 8/1960 | United Kingdom . | |
| WO90/03873 | 4/1990 | WIPO . | |
| WO91/03592 | 3/1991 | WIPO . | |

OTHER PUBLICATIONS

"Hot Wire Cutter For Flexible Recording Media", Burr, P. and Paton, A., IBM Technical Disclosure Bulletin, vol. 25, No. 10, Mar. 1983.

*Primary Examiner*—Rinaldi I. Rada
*Attorney, Agent, or Firm*—Friedrich Kueffner

[57] ABSTRACT

A process for the thermal cutting of a running, meltable fabric run includes cutting the fabric run by a hot cutting wire. The cutting wire extends in a plane extending essentially perpendicularly to the travel direction of the fabric run. The cutting wire is inclined relative to the fabric run by an angle of greater than 0° and smaller than 90°.

12 Claims, 3 Drawing Sheets

PROCESS AND DEVICE FOR THE THERMAL CUTTING OF A RUNNING, MELTABLE FABRIC RUN

TECHNICAL FIELD

The invention relates to a process for the thermal cutting of a running, meltable fabric run and as to a device for carrying out the process according to the part of claim 6 describing the background art.

BACKGROUND ART

Processes and devices for the thermal cutting of a running, meltable fabric run are known in from several sources, e.g. from WO-A-9103592 and EP-A- 0389793. With these known processes and devices the meltable fabric run is cut by means of a hot cutting wire, the cutting wire being inclined to the fabric run at an angle of 90° perpendicular to the cutting direction. This involves the disadvantage that due to the melted mass produced at the cutting point, relatively hard and rough melted edges are produced on thermal cutting. According to EP-A-0389793 the attempt was made to avoid these disadvantages in that the edge areas with the melted edges are folded over along folding lines parallel with the edges of the cut, whereafter the folding legs are pressed flat onto the adjoining surface zones of the material strip and fastened there by gluing. This procedure is relatively complicated, and an also relatively thick edge area ensues.

From EP-A-0152672 the technique of cutting a running, meltable fabric run, in the process of which the cut edge is furnished with a beveled cut surface, is known. This purpose is served by an ultrasonic cutting head with a V-shaped cutting element which has the form of an anvil and which interacts with an ultrasonic horn. The melting head is produced in the fabric material by friction between the anvil and ultrasonic horn. Irrespective of the fact that this cutting head is very complicated and susceptible to wear, and that it has a relatively large space requirement, the fabric material is displaced by the V-shaped anvil and produces large beads which adversely affect the appearance and the feel of the fabric material. In addition, the cutting operation nevertheless only conditionally produces edges resistant to fraying.

DISCLOSURE OF THE INVENTION

The objective of the present invention is to devise a process and a device for the thermal cutting of a running, meltable fabric run by means of which the disadvantages mentioned above are avoided.

In accordance with the present invention, the process for the thermal cutting of a running, meltable fabric run is carried out by means of a hot cutting wire which extends in a plane extending essentially perpendicular to the the travel direction of the fabric run and is inclined at an angle of greater than 0° and smaller than 90° relative to the fabric run.

As a result of the inclined cut, on the one hand a part of the melt is allocated to a waste cutting strip, and on the other hand the melted edge is at the rear of the fabric run, so that it is not perceivable. The edges of the cut surface are rounded and essentially smooth. By virtue of the lengthened cut surface of the inclined cut by contrast with the perpendicular cut, the threads of the fabric run melt together better, thereby also improving the cut edge of the fabric run. By virtue of the inclined cut surface, the cut fabric run can be bent around significantly smaller radii without breaking than is the case with perpendicularly cut surfaces. The cutting operation can take place along a straight line and/or any given path.

The cut can be carried out by means of a single straight cutting wire in a correspondingly inclined position. Of special advantage is an embodiment in which the cutting wire is V-shaped, since two material runs can be cut simultaneously with a single cut, the part of the material run inside the Vs being removable as waste cutting. With this waste cutting a part of the melt produced by the cut is removed. A cut with a V-shaped cross section can be produced with an X-shaped cutting wire. Especially advantageous is an embodiment in which the projecting edge of the cut surface is arranged on the exterior side of the fabric run. This causes a greater quantity of the melt to be located at the rear of the fabric run and not to be noticeable from the exterior side. Patterned fabric runs such as are used for patterned label ribbons in particular offer a further advantage in that only a scarcely perceivable bead forms on the exterior side because the cut was made through the homogeneous ground fabric. The edge is rounded and does not scratch characteristics. Visually, the cut comprises the cut through the ground fabric and the cut through the figure fabric or through the figure threads at the back of the fabric. The cut through the ground fabric proves to be very homogeneous in density, as well as in the color of the ground fabric. The forward edge does not have the otherwise commonly visible mixed color effects as in the case of the known perpendicular straight cut. By virtue of the greater cutting length of the inclined cut, in particular the melting together of the figure threads is improved. Thread pull-out without destruction of the label is therewith scarcely possible. The inclined cut surfaces can be pressed together optimally with rolls. In this process the material on the back of the ribbon can be effectively folded over toward the center of the fabric, thereby yielding a very fine, thin, non-scratching fabric selvedge.

Particularly advantageous is also an embodiment in which the fabric run is furnished with a warp thread along the cutting line, wherein the warp thread has a higher resistance to high temperature than adjacent textile threads. A V-shaped or X-shaped cutting wire is guided such that the warp thread is located inside the cutting wire and the warp thread is preferably not melted by the cutting wire. The warp threads with the higher temperature resistance inserted in the complementary cutting process yield an optimum guiding possibility for the V- or X-shaped cutting wire. Hence the latter is guided by such a warp thread along the cutting direction, thereby producing an extremely straight cut accurate to the thread.

BRIEF DESCRIPTION OF THE DRAWING

Examples of embodiments of the subject of the invention are described in detail below on the basis of drawings. Shown are.

MODE FOR CARRYING OUT THE INVENTION

Figure 1:
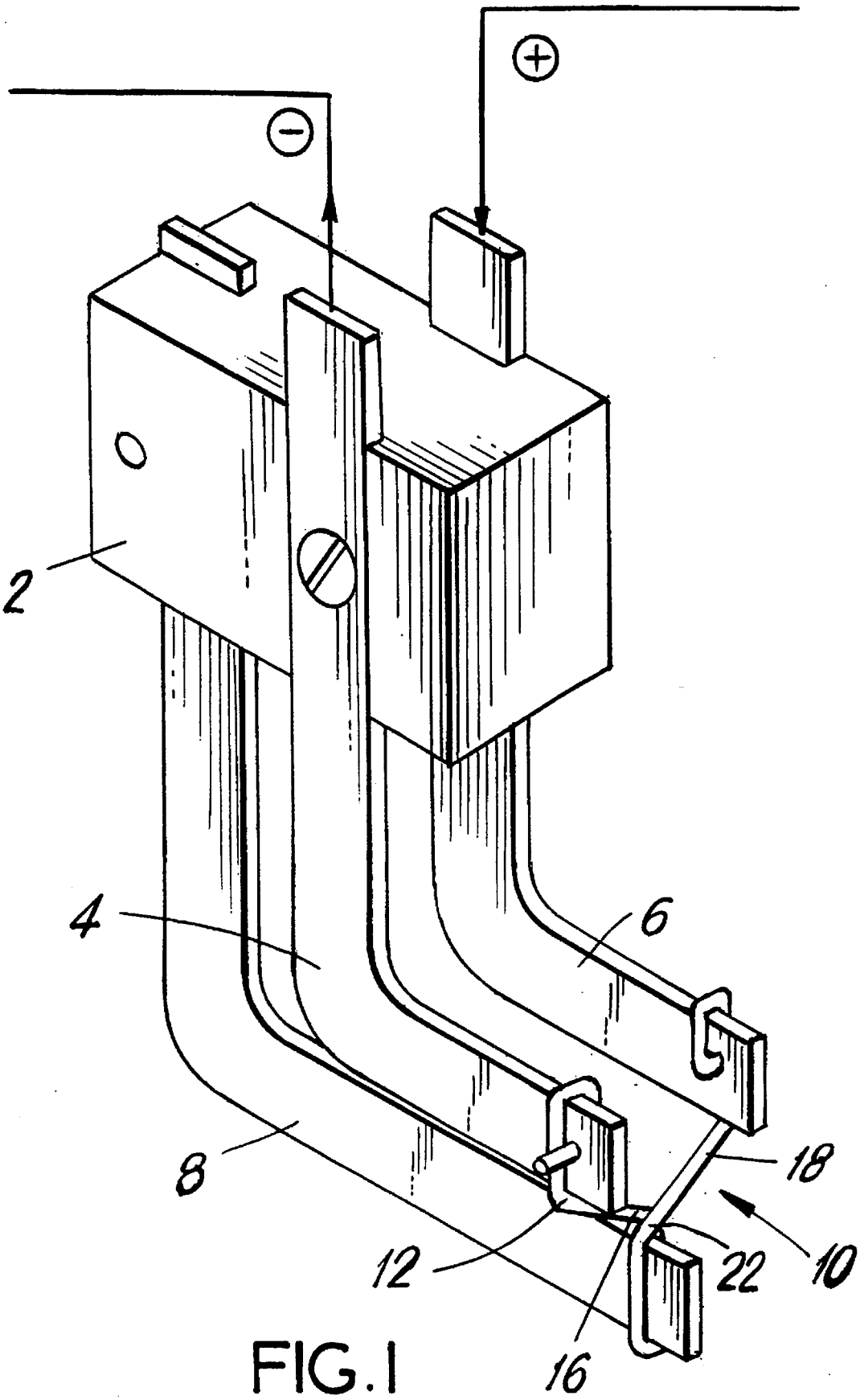
FIG. 1 a cutting head in perspective view.

FIG. 1 shows a cutting head which is suitable for cutting the most diverse types of fabric runs and for the most diverse applications. It is especially suitable for a device for manufacturing a patterned label ribbon according to EP-A-0389793. The cutting head contains a carrier 2 which can be fastened to any arbitrary support of a fabric run production installation. Arranged on the carrier are angled carrying arms 4, 6, 8, the free ends of which face in the direction of travel of a fabric run. A cutting element 10 consisting of cutting wire 12 of V-shaped arrangement is fastened to the front end of the carrying arms 4, 6, 8. Serving this purpose, an end of the cutting wire 12 is fastened to one carrying arm 4; the wire is then wrapped around a lower carrying arm 8 and then fastened to the second upper carrying arm 6. The current required to heat the cutting wire 12 is supplied via the carrying arms 4, 6.

Figure 2:
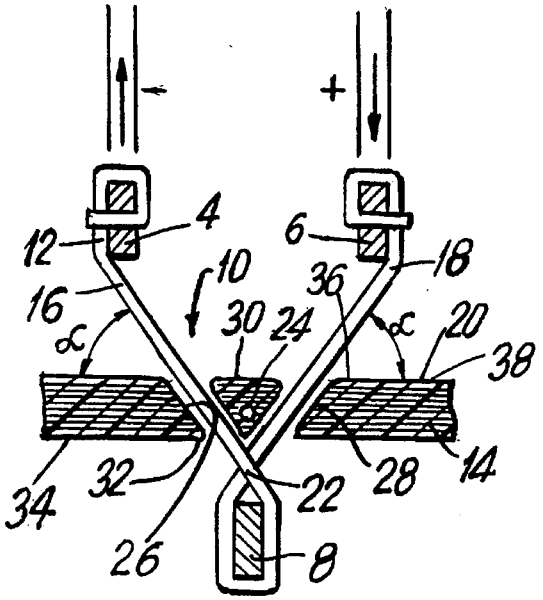
FIG. 2 a V-shaped cutting wire of the cutting head of FIG. 1 used in cutting a fabric run in cross-sectional view perpendicular to the cutting direction.

FIG. 2 shows the cutting wire 12 being used on a meltable fabric run 14. The legs 16, 18 of the cutting wire 12 are inclined at an angle α from the surface 20 of the fabric run 14 perpendicular to the cutting direction. The arrangement is laid out such that the intersection point 22 of legs 16, 18 of the cutting wire 12 is closely beneath the fabric run 14, and that the cutting wire cuts the fabric run by melting the textile threads. In the example shown the fabric run 14 has a warp thread 24 along the cutting line with a higher resistance to high temperatures than the adjoining textile threads. The cutting wire 12 is thereby guided along the warp thread 24, i.e. along the cutting line. In thermal cutting, melted cut surfaces 26, 28 are produced which are arranged V-shaped corresponding to the cutting wire 12. Since in the case of thermal cutting some of the melted material is part of the waste cutting 30 inside the Vs of cutting wire 12, the melting area on the cut surfaces 26, 28 is reduced, thereby inhibiting bead formation. By virtue of the inclination of the cut surfaces 26, 28 a larger melt surface is obtained, thereby improving the fixing of the fabric run threads. Since the arrangement is such that the projecting edge 32 is made on the exterior side 34 of the fabric run 14, and that the rear edge 36 is consequently on the interior side 38 of the fabric run, the cut surface 26, 28 on the exterior side 34 of the fabric run is almost not visible. By the inclination of the cut surface the formation of beads on the cut surface or in particular on the exterior side i.e. in the visible area is prevented. The appearance of the cut fabric run is thereby improved, and a softer, smooth cut is produced.

Figure 3:
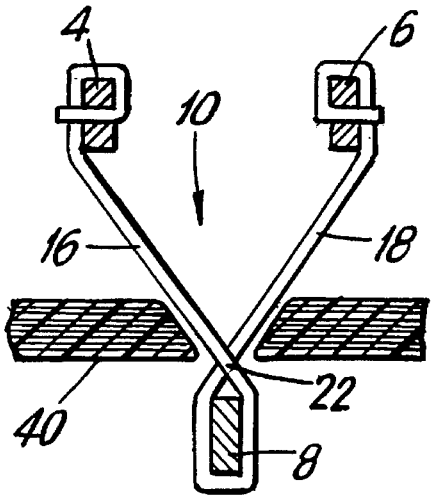
FIG. 3 a V-shaped cutting wire of FIG. 1 in another fabric run cutting application in cross-sectional view perpendicular to the cutting direction.

FIG. 3 shows a V-shaped cutting wire according to FIGS. 1 and 2 on a fabric run 40, but without a warp thread 24 such as shown in FIG. 2 which would serve for guiding along the cut line. In the case of a cutting operation according to FIG. 3, almost no waste cuttings are produced between the legs 16, 18.

Figure 4:
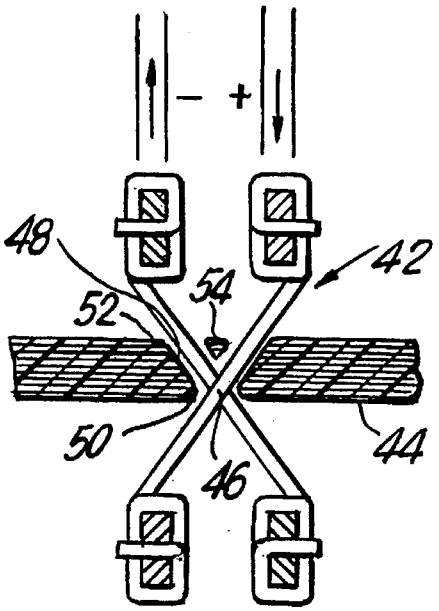
FIG. 4 an application of an X-shaped cutting wire in cross sectional view perpendicular to the cutting direction.

FIG. 4 shows a further cutting wire 42 of X-shaped construction. When the fabric run 44 is cut, the arrangement is designed such that the intersection point 46 of the cutting wire 42 is located inside the fabric run 44, thereby producing an angled cut surface 48 with retracted edges 50, 52 on both sides of the fabric run. After the cutting any waste cuttings 54 produced inside the X-shaped cutting wire 42, depending on the depth adjustment of the intersection point 46, is removed.

Figure 5:
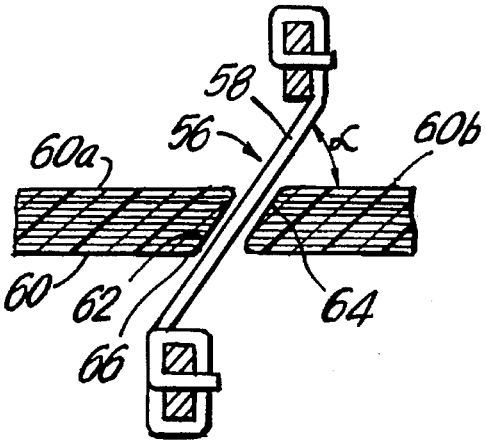
FIG. 5 an application of a further inclined cutting wire in cross-sectional view perpendicular to the cutting direction.

FIG. 5 shows a further cutting element 56 constructed in the form of a single cutting wire 58 which is inclined at an angle α to the fabric run 60 perpendicular to the cutting direction. Since the cut surfaces 62, 64 represent exactly opposite cuts, the two fabric run sections 60*a*, 60*b* must be used either with opposite sides up, or the fabric run section 60*a*, on the exterior side of which edge 66 is retracted, must be cut once again with a cutting wire 56 with an inclination opposite that of the cutting wire shown in FIG. 5.

In the examples shown the cutting wires are all constructed of round material. However, it is also possible to manufacture the cutting wires from a flat material, the narrow side of which forms the cutting edge.

Figure 6:
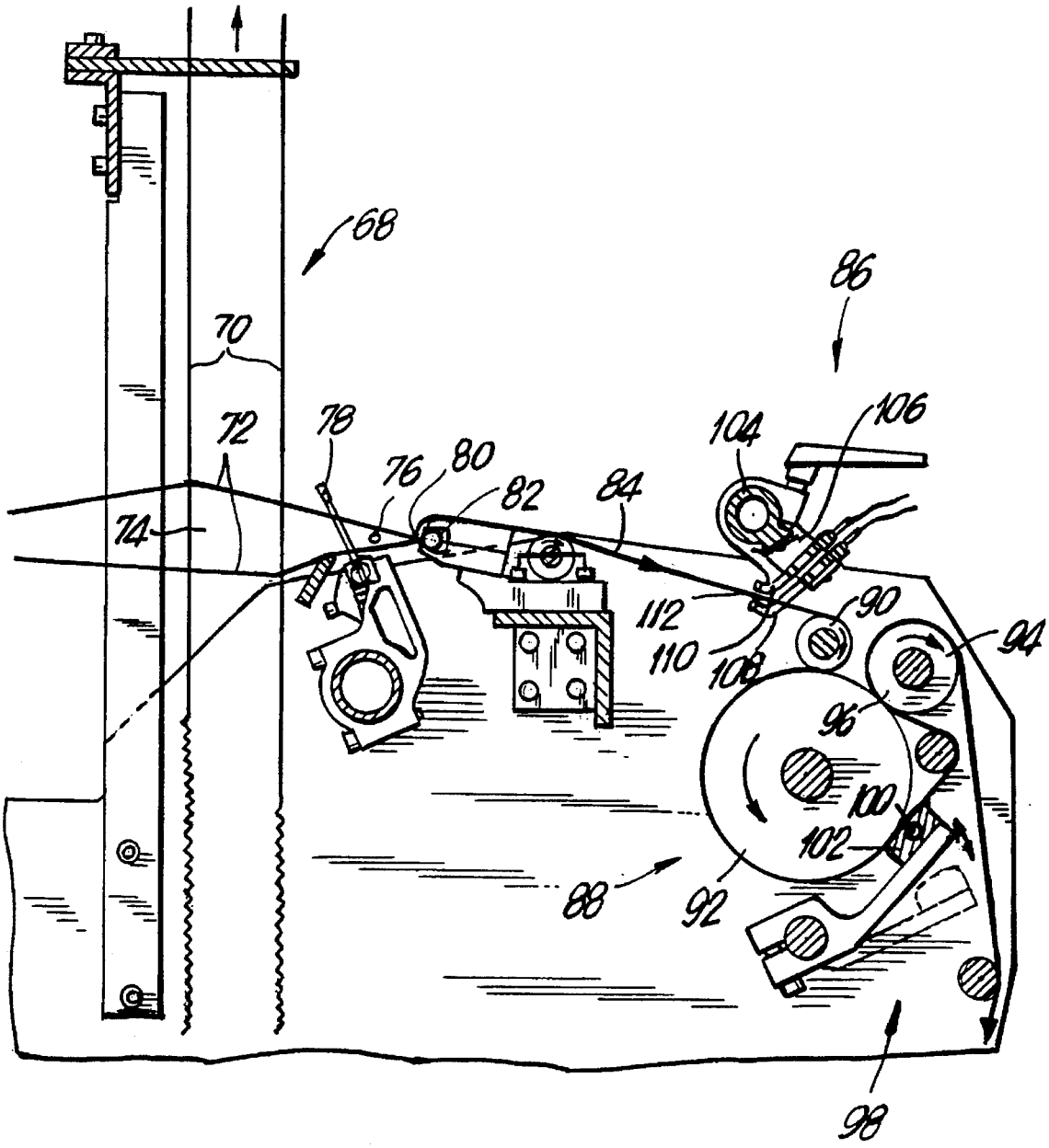
FIG. 6 a loom with a device for thermal cutting, in vertical cross-sectional view.

FIG. 6 shows a loom with a device for thermal cutting according to any one of FIGS. 1 to 5. The loom serves for the manufacture of patterned label ribbons by the thermal cutting of a broad-woven fabric run.

The loom includes a weaving area 68 with warp threads 72 of meltable material. The warp threads 72 are guided by heddles 70 so as to form a shed 74. A weft thread 76 is inserted into the shed 74 and is beat by means of a reed 78 against a selvage 80. A fabric hold-down device 82 serves to guide the woven fabric run 84 to a thermal cutting device 86 by which the fabric run 84 is cut into ribbons that are taken off by a fabric take-off device 88 and a fabric beam, not shown. The fabric take-off device 88 is equipped with a first deflector roll 90, a take-off roll 92 and further deflector rolls 94, 96. It is also equipped with a thermofixing device 98. The latter contains a pad 102 that is heated by a heater 100.

The cutting device 86 is equipped with brackets 106 which are arranged on a support 104 overreaching the fabric run 84, said brackets being fitted with carrying arms 108, 110 which carry the cutting element 112 on their front end areas facing the direction of travel of the fabric run.

I claim:

1. A process for the thermal cutting of a running, meltable fabric run traveling in a travel direction, the process comprising cutting the fabric run by means of a hot cutting wire, wherein during cutting of the fabric run the cutting wire extends in a plane extending essentially perpendicularly to the travel direction of the fabric run and wherein the cutting wire is inclined relative to the fabric run at an angle which is greater than 0° and smaller than 90°.

2. The process according to claim 1, wherein the cutting wire has a round cross-section.

3. The process according to claim 1, wherein the cutting wire comprises two legs which are inclined relative to each other to form a V-shaped cutting wire.

4. The process according to claim 1, wherein the cutting wire comprises two legs which are inclined relative to each other and intersect each other in an intersection point to form an X-shaped cutting wire, the fabric run having a width, further comprising guiding the X-shaped cutting wire such that the intersection point is within the width of the fabric run.

5. The process according to claim 1, wherein the fabric run has an exterior side, wherein cutting of the fabric run results in a cut surface having a projecting edge, the projecting edge is located on the exterior side.

6. The process according to claim 1, wherein the fabric run comprises a warp thread which has a higher resistance to high temperature than adjacent textile threads, the cutting wire comprising two legs extending inclined relative to each other to form one of a V-shaped cutting wire and a X-shaped cutting wire, an area being defined between the legs of the cutting wire, further comprising guiding the cutting wire such that the warp thread is located within the area between the legs of the cutting wire and the warp thread is not melted by the cutting wire.

7. A device for thermal cutting of a meltable fabric run traveling in a travel direction, the device comprising a cutting wire, means for heating the cutting wire, the cutting wire comprising an active portion for cutting the fabric run, wherein during cutting of the fabric run the active portion of the cutting wire extends in a plane extending essentially perpendicular to the travel direction, and wherein the active portion of the cutting wire is inclined relative to the fabric run at an angle of greater than 0° and smaller than 90°.

8. The device according to claim 7, wherein the cutting wire has a round cross-section.

9. The device according to claim 7, wherein the active portion of the cutting wire comprises two legs, the two legs being inclined relative to each other so as to form a V-shaped cutting wire.

10. The device according to claim 7, wherein the active portion of the cutting wire comprises two legs, the two legs being inclined relative to each other and intersecting each other to form a X-shaped cutting wire.

11. The device according to claim 7, wherein the device is arranged in a loom having a weaving area and a fabric beam, the device being arranged between the weaving area and the fabric beam.

12. The device according to claim 7, wherein the cutting wire is mounted on finger-like carrier arms directed in a direction opposite the travel direction of the fabric run.

* * * * *